US008267104B2

(12) United States Patent
Li

(10) Patent No.: US 8,267,104 B2
(45) Date of Patent: Sep. 18, 2012

(54) CONTROLLER UNIT WITH ELECTRONIC APPLIANCE HOLDER FOR OUTDOOR SHADING DEVICE

(75) Inventor: Wanda Ying Li, Irvine, CA (US)

(73) Assignee: Oliver Joen-An Ma, Arcadia, CA (US)

( * ) Notice: Subject to any disclaimer, the term of this patent is extended or adjusted under 35 U.S.C. 154(b) by 60 days.

(21) Appl. No.: 12/804,485

(22) Filed: Jul. 21, 2010

(65) Prior Publication Data

US 2012/0017954 A1 Jan. 26, 2012

(51) Int. Cl.
*E04H 15/02* (2006.01)

(52) U.S. Cl. ..... 135/96; 135/16

(58) Field of Classification Search ..... 135/16
See application file for complete search history.

(56) References Cited

U.S. PATENT DOCUMENTS 7,497,225 B1 * 3/2009 Klein et al. ..... 135/16
7,755,975 B2 * 7/2010 Pettersen et al. ..... 367/131
2003/0192579 A1 * 10/2003 Llamas Garijo ..... 135/16
2008/0056898 A1 * 3/2008 Li ..... 416/142
2008/0163908 A1 * 7/2008 O'Kere ..... 135/16
2008/0271768 A1 * 11/2008 Li ..... 135/16
2009/0284216 A1 * 11/2009 Bessa et al. ..... 320/101
2010/0307547 A1 * 12/2010 Li ..... 135/16
2010/0319737 A1 * 12/2010 Li ..... 135/16

* cited by examiner

*Primary Examiner* — Noah Chandler Hawk
(74) *Attorney, Agent, or Firm* — Raymond Y. Chan; David and Raymond Patent Firm

(57) ABSTRACT

A controller unit for electrically controlling an outdoor shading device having an awning frame and a supporting frame, includes a operation housing mounted on the supporting frame of the outdoor shading device, wherein the operation housing has a surrounding wall; a control panel being supported on the surrounding wall of the operation housing at a predetermined location for controlling one or more electronic appliances of the outdoor shading device; and an electronic appliance holder assembly for holding at least an electronic appliance thereat and electrically linking with the control panel, wherein the holder assembly is located on the surrounding wall of the operation housing and being arranged that the electronic appliance holder assembly is located at an opposed side of the surrounding wall with respective to the control panel.

9 Claims, 15 Drawing Sheets

A–A

B–B

C—C

CONTROLLER UNIT WITH ELECTRONIC APPLIANCE HOLDER FOR OUTDOOR SHADING DEVICE

BACKGROUND OF THE PRESENT INVENTION

1. Field of Invention

The present invention relates to a controller unit with holder for holding electronic appliance in position, and more particularly to the controller unit with electronic appliance holder for outdoor shading device.

2. Description of Related Arts

Outdoor shading device are usually provided in a campground, on a beach, or in the back yard of the house to give a pleasant shade for a user under the sun. Usually, the user uses the outdoor shading device especially on a sunshine day to prevent the sun directly pours on the user and coolers the temperature. Meanwhile, the user may want to listen to the music through a portable music player, charging the cell phone, or turning on the portable fan etc.

A conventional shading device, such as a conventional outdoor umbrella, generally comprises a supporting frame and a shading system supported by the supporting frame to define the predetermined shading area under the shading system. Over the years, there have been extensive developments for improving the quality and functions of such conventional shading device. For example, an outdoor umbrella may be equipped with a solar energy collection arrangement and a lighting system for providing environmental friendly illumination for the relevant users. Moreover, another shading device, such as a conventional gazebo, may be equipped with a specially designed ventilation system so that users of the gazebo have adequate access to fresh air when they are gathering within the gazebo while preserving their privacy.

Notwithstanding these developments, conventional shading devices, even with some sophisticated improvements, such as the lighting system and the speaker of the sound system, are usually not responsive enough to the change of environmental circumstances in which the shading devices operate. This discrepancy may be partially resolved by manual operation of the shading devices. For example, a user may easily turn on or turn off the illumination system whenever necessary. In some situations, however, frequent manual operation of the shading system may mean inconvenience and interruption of a scheduled activity in the shading system.

Therefore, a control panel may further be adapted for centrally and electrically control one or more electronic appliances incorporated with the outdoor shading device, such that the user is able to conveniently and adjustably control the electronic appliance through the control panel. For instance, the user may adjust the volume of the speaker mounted on the frame of the outdoor shading device via the control panel.

On the other hand, along with the growth of personal portable electronic devices become more and more popular, there raise a great need for incorporating the electronic device with the functional entertaining system of the outer shading device, such as electrically connecting the iPod Touch to the speaker for playing music therein. Therefore, the present invention provides a controller unit having electronic appliance holder for incorporating the control panel and the electronic appliances including the personal portable electronic devices, so that the user is able to easily incorporating their own portable personal device of the electronic appliances with the outdoor shading device.

SUMMARY OF THE PRESENT INVENTION

The present invention is advantageous in that it provides a controller unit with at least an electronic appliance holder for an outdoor shading device, so that a user is able to electrically connect a portable electronic device of the electronic appliance with the controller unit to conveniently incorporate the electronic appliance with the outdoor shading device.

Another advantage of the present invention is to provide a controller unit with at least an electronic appliance holder for an outdoor shading device, wherein the control panel has one or more connecting slots for electrically connecting with one or more electronic appliances therethrough, so as to incorporate the electronic appliance, such as the personal portable electronic device, with the outdoor shading device.

Another advantage of the present invention is to provide a controller unit with at least an electronic appliance holder for an outdoor shading device, wherein the control panel of the controller unit and the electronic appliance holder is located at two opposed sides of the operation housing, so that the electronic appliance being held on the holder is able to conveniently and electrically link with the control panel, so as to integral the electronic appliances with the outdoor shading device.

Another advantage of the present invention is to provide a controller unit with at least an electronic appliance holder for an outdoor shading device, wherein the operation housing is able to coaxially coupling with the supporting frame to form a compacted and integrated controller unit and the electronic appliance holder thereat.

Another advantage of the present invention is to provide a controller unit with at least an electronic appliance holder for an outdoor shading device, wherein the holder is able to be rotatably adjusted to a predetermined angle, so as for conveniently viewing or controlling the electronic appliance being held thereat.

Additional advantages and features of the invention will become apparent from the description which follows, and may be realized by the following description of the instrumentalities and combinations particular pointing out in the appended claims.

According to the present invention, the foregoing and other objects and advantages are attained by providing an outdoor shading device which comprises a supporting frame and an awning frame movably supported by the supporting frame to define a shading area under the awning frame.

The outdoor shading device further comprises a controller unit, which comprises:

an operation housing mounted on the supporting frame at a hand reachable location, wherein the operation housing has a first wall surface and a second wall surface;

a control panel being supported at the first wall surface of the operation housing; and an electronic appliance holder provided at the second wall surface of the operation housing for holding at least an electronic appliance thereat, wherein the control panel is adapted for communicatively linking to the electronic appliance to selectively control an operation of the electronic appliance.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
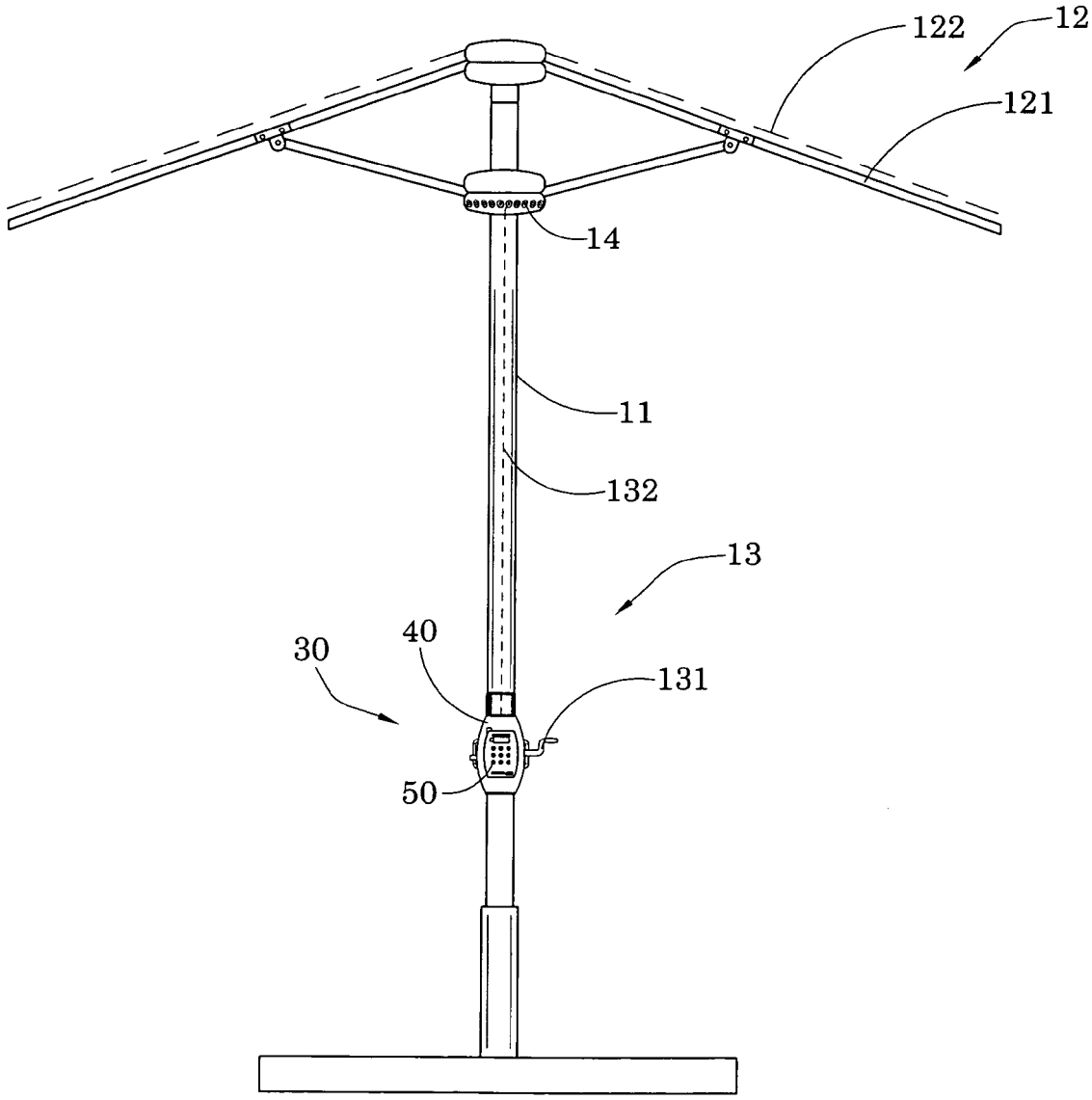
FIG. 1 is a perspective view of an outdoor shading device with a controller unit according to a preferred embodiment of the present invention.

Referring to FIGS. 1 to 5 of the drawings, an outdoor shading device 10 according to a preferred embodiment of the present invention is illustrated, wherein said outdoor shading device 10, which is embodied as an outdoor umbrella, comprises a supporting frame 11 and an awning frame 12 movably supported on top of the supporting frame 11 to define a shading area under the awning frame 12. More specifically, the awning frame 12 comprises a plurality of awning arms 121 radially and pivotally coupling with the top end of the supporting frame 11, and an awning shelter 122 supported by the awning arms 121 to define the shading area under the awning shelter 122.

The outdoor shading device 10 further comprises a controller unit 30 for centrally and selectively controlling one or more electronic appliances 20 incorporated with the outdoor shading device 10 via electrically link to a CUP of the controller unit 30. The outdoor shading device 10 may includes fans, speaker system 14, environmental sensor device, lighting apparatus, wherein the electronic appliances 20 can be any personal portable electronic device 21 electrically linking to the controller unit 30 for adjustably controlling the electronic appliances 20. Therefore, a user is able to incorporate his/her own portable electronic device 21 with the outdoor shading device. For instance, the user is able to electrically connect the "iPhone", other smart phones, or MP3 player of portable electronic device 21 to the controller unit 30 for playing music through the integrated speakers of the outdoor shading device 10 and controllably adjust the volume of the speaker through the controller unit 30. According to the preferred embodiment, the speaker system 14 is supported within the shading area under the awning frame 12 and is an integrated component of the outdoor shading device 10.

The outdoor shading device 10 further comprises an awning folding arrangement 13, which is operatively connecting with the awning frame 12 for movably folding the awning frame 12 between a folded position and an unfolded position. At the folded position, the awning arms 121 are pivotally moved at a position that the awning shelter 122 is folded up to minimize the shading area thereof; and at the unfolded position, the awning arms 121 are pivotally expanded at a position that the awning shelter 122 is to maximize the shading area thereof.

It should be noted that the awning folding arrangement 13 may electrically connect to the controller unit 30 for being automatically controlled between the folded and unfolded positions. The awning folding arrangement 13 may also be arranged that the awning frame 12 is able to be manually operated to move the awning frame 12 between the folded and unfolded positions.

As one of the embodiments for the manually operated outdoor shading device 10, the awning folding arrangement 13 comprises a folding cable extended within the supporting frame 11 to the awning frame 12 and a manual operation handle 131 provided at the supporting frame 11 for operatively controlling with the awning frame 12 via the folding cable 132, such that the user is able to rotatably move the operating handle 131 for manually folding the awning frame 12 between the folded and unfolded positions.

According to the preferred embodiment, the controller unit 30 comprises an operation housing 40 mounted on the supporting frame 11 at a hand reachable location, wherein the operation housing 40 has a first wall surface 41 and a second wall surface 42, and a control panel 50 being supported at the first wall surface 41 of the operation housing 40.

According to the preferred embodiment, the awning folding arrangement 13 is received at the operation housing 40 such that the operation housing 40 forms an integrated component of the outdoor shading device 10. Accordingly, the operation handle 131 is rotatably coupled at the operation housing 40 between the first and second wall surfaces 41, 42 thereof to actuate the folding cable 132 for controlling a folding operation of the awning 122 between the unfolded position and the folded position.

The controller unit 30 further comprises an electronic appliance holder 60 provided at the second wall surface 42 of the operation housing 40 for holding the electronic appliance thereat, wherein the control panel 50 is adapted for communicatively linking to the electronic appliance to selectively control an operation of the electronic appliance.

As shown in FIGS. 3 to 7, the first and second wall surfaces 41, 42 of the operation housing 40 are two opposed surfaces and are enlarged flat surfaces to incorporate with the control panel 50 and the electronic appliance holder 60 respectively. Therefore, the operation housing 40 is able to support both the controller unit 30 and the electronic appliance holder 60 at the same time. Accordingly, the electronic appliance holder 60 is preferably adapted for holding the electronic appliances 20 thereon, especially the personal portable electronic device 21 as mentioned above. Thereby, the electronic appliance holder 60 is able to mount on the supporting frame 11 via the operation housing 40, and arranged that the portable electronic device 21 is able to be securely held at a position adjacent to the controller unit 30. Thus, the portable electronic device 21 is able to easily and electrically connect to the controller unit 30 for incorporating with other electrical components of the outdoor shading device 10.

Accordingly, the operation housing 40 further has a receiving cavity 43 indently formed at the second wall surface 42 to detachably receive the electronic appliance holder 60 within the receiving cavity 43.

According to the preferred embodiment, the control panel 50 comprises a controller interface 51 and a wireless communication link 52 for communicatively linking with the electronic appliance 20 in a wireless connection manner, so as to enable the controller interface 51 being activated to control the operation of the electronic appliance.

Figure 2:
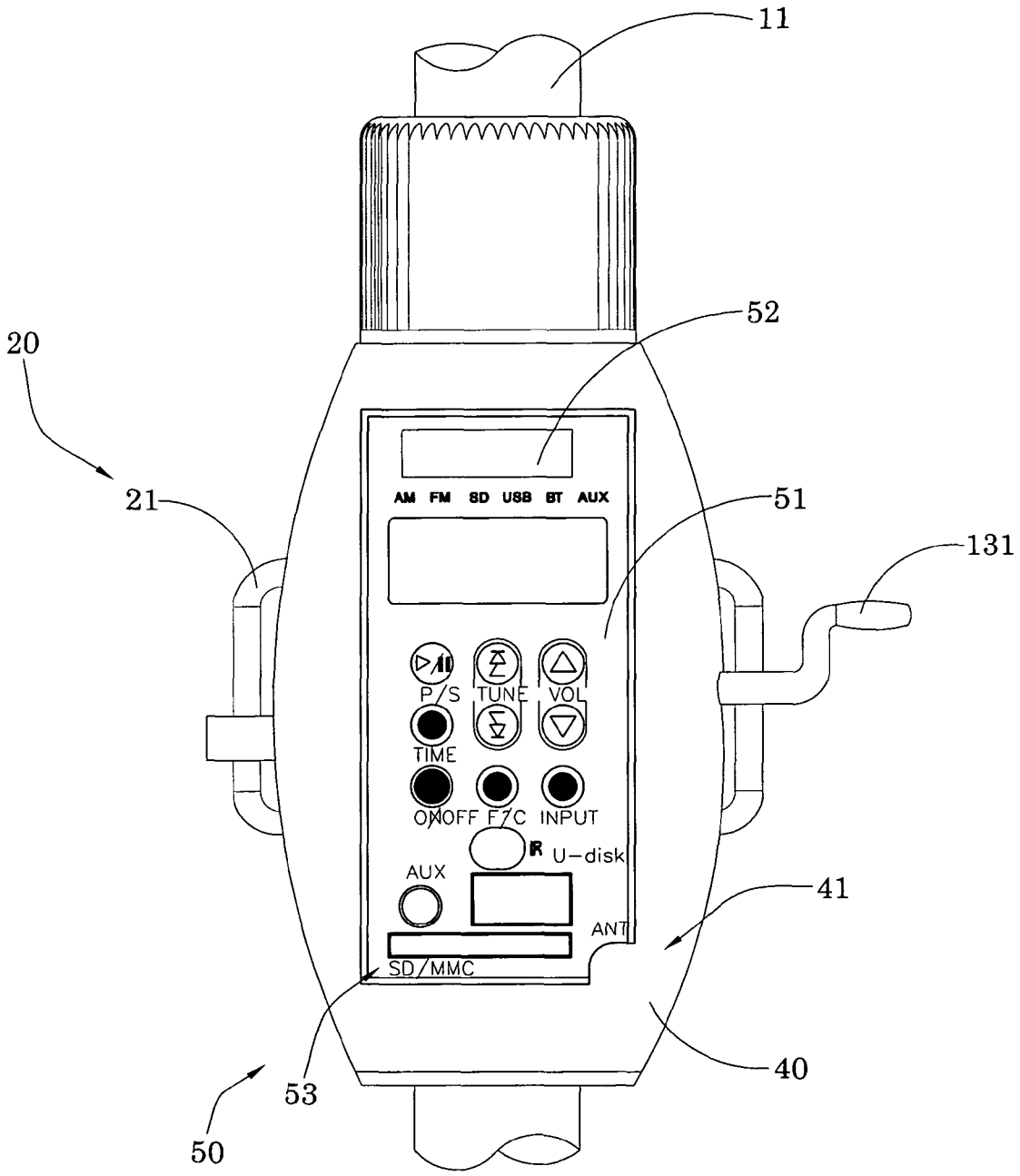
FIG. 2 is a front view of the controller unit according to the above preferred embodiment of the present invention, illustrating the control interface of the controller unit.

As shown in FIG. 2, the controller interface 51 has a plurality of preference settings, remotely control the electronic appliance 20 and the electrical components of the outdoor shading device 10 for centrally activating the outdoor shading devices 10 in responsive to the preference settings, such as light intensity, volume, and time etc. For instance, the preference settings may comprises a plurality controlling keys for selectively adjust the volume by pressing UP or DOWN keys thereof, and/or for increasing or decreasing the light intensity of the lighting apparatus of the outdoor shading device 10. Alternatively, the preference settings may be adjusted via a touch screen controlling panel.

The control panel 50 further comprises one or more connecting slots 53, such as SD card slot and/or USB slot, for electrically linking with external electronic appliances 20, such as the above mentioned portable electronic device 21, so that the portable electronic device 21 is able to simply plug into the connecting slot 53 for incorporating with the outdoor shading device 10 via a connecting cable. Therefore, the user is able to simply plug a MP3 player of the portable electronic device 21 for electrically linking the MP3 player with the speaker of the electronic appliance 20 of the outdoor shading device 10 and/or place the personal portable electronic device 21 at the holder for conveniently connecting to the connecting slot 53, so that the user is able to play the music through the speaker of the outdoor shading device 10, so as to adjust the volume or the likes through the setting preferences on the control panel 50.

The electronic appliance holder 60 has a storage side 61 and an opposed holding side 62 arranged in such a manner that when the storage side 61 of the electronic appliance holder 60 is engaged with the operation housing 40, the holding side 62 of the electronic appliance holder 60 faces outwardly for holding the electronic appliance 20 in position, and when the holding side 62 of the electronic appliance holder 60 is engaged with the operation housing 40, the storage side 61 of the electronic appliance holder 60 is aligned with the second wall surface 42 to house the electronic appliance holder 60 at the operation housing 40.

Figure 3:
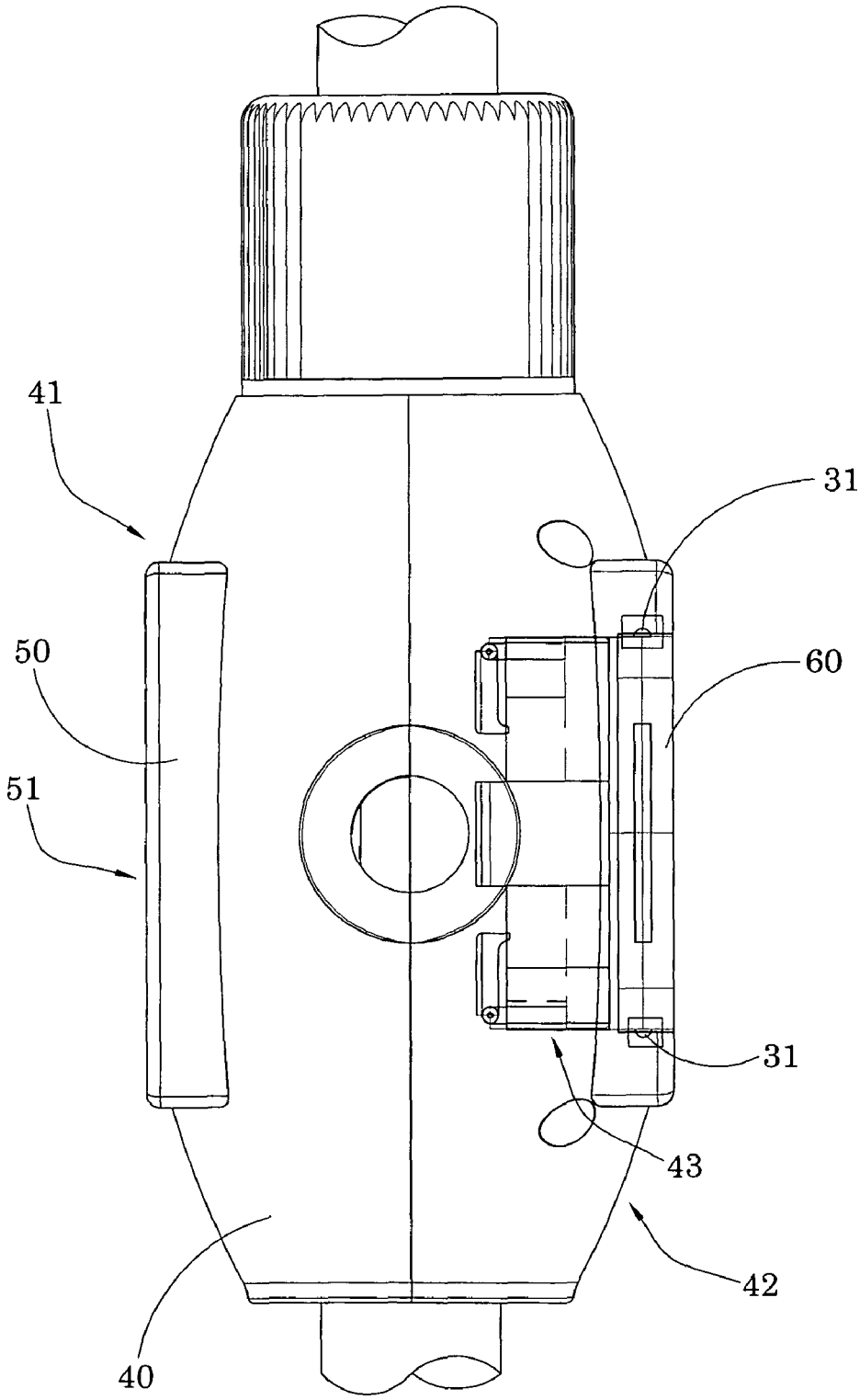
FIG. 3 is a side sectional view of the controller unit according to the above preferred embodiment of the present invention, illustrating the retraction unit receiving in the receiving cavity of the operation housing in a hidden manner.
Figure 6:
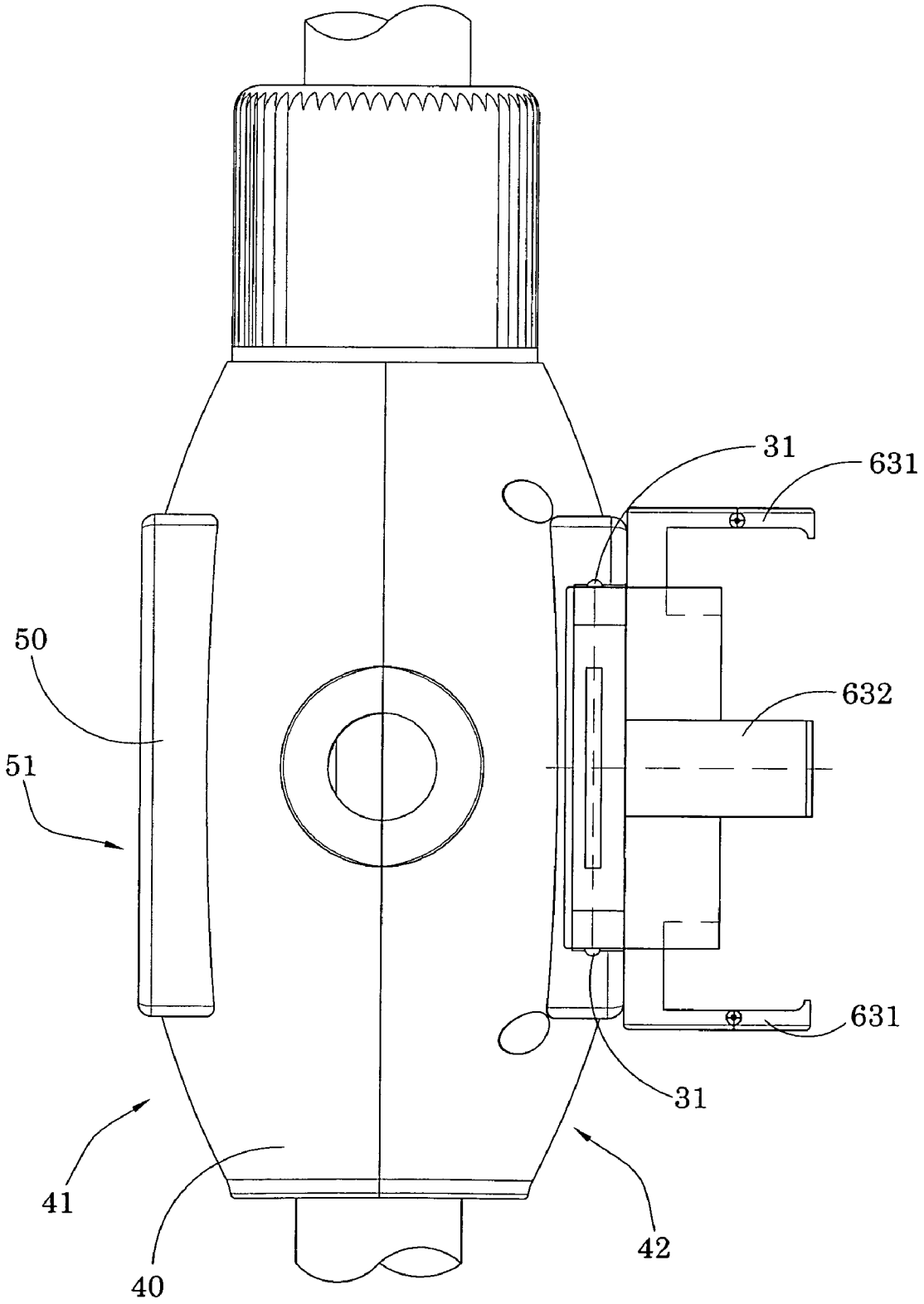
FIG. 6 is still another side sectional view of the controller unit according to the above preferred embodiment of the present invention, illustrating the retracting arms at an extended position.
Figure 7:
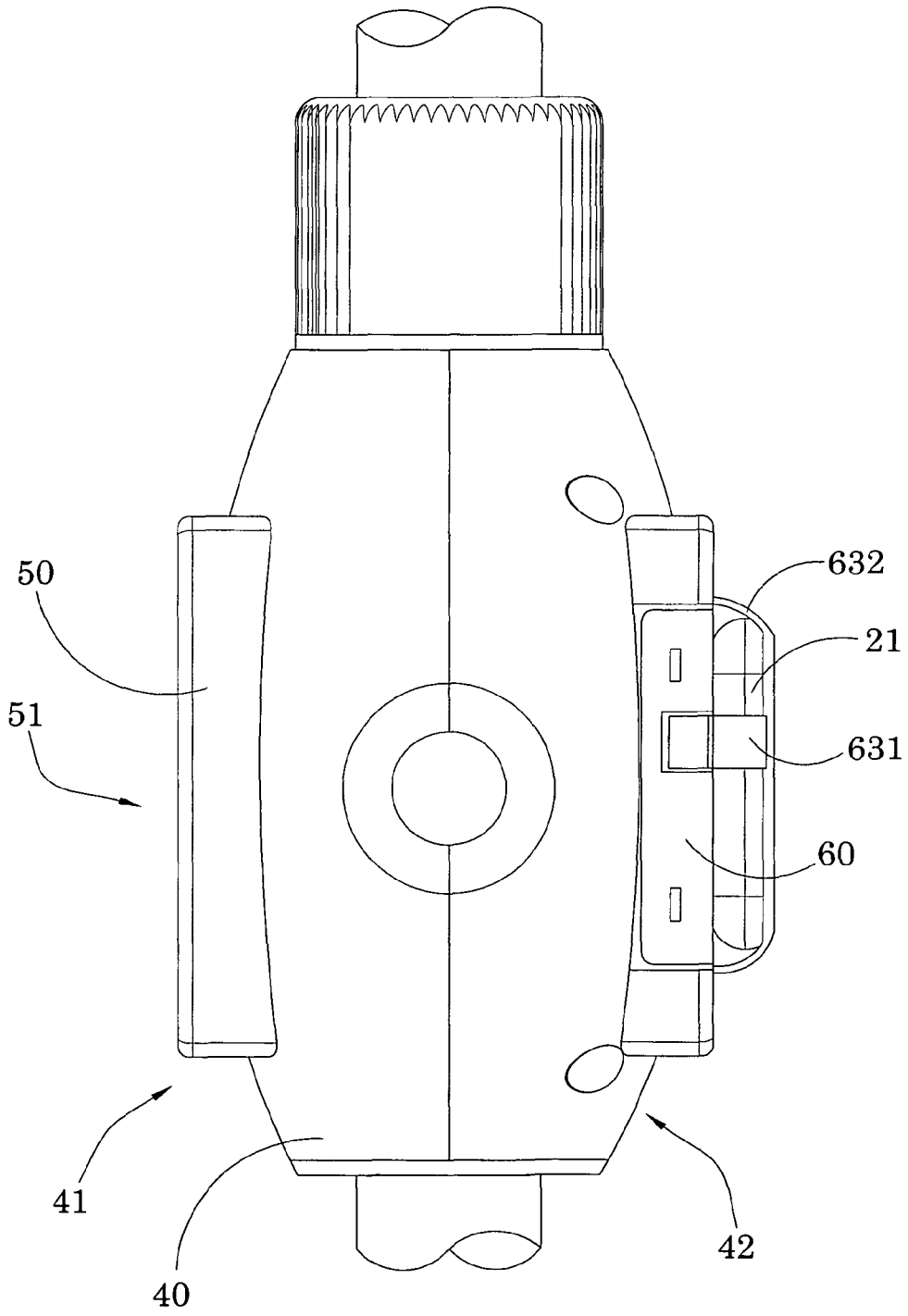
FIG. 7 is a sectional view of the controller unit according to the above preferred embodiment of the present invention, illustrating the storage side of the electronic appliance holder facing outwardly.
Figure 8:
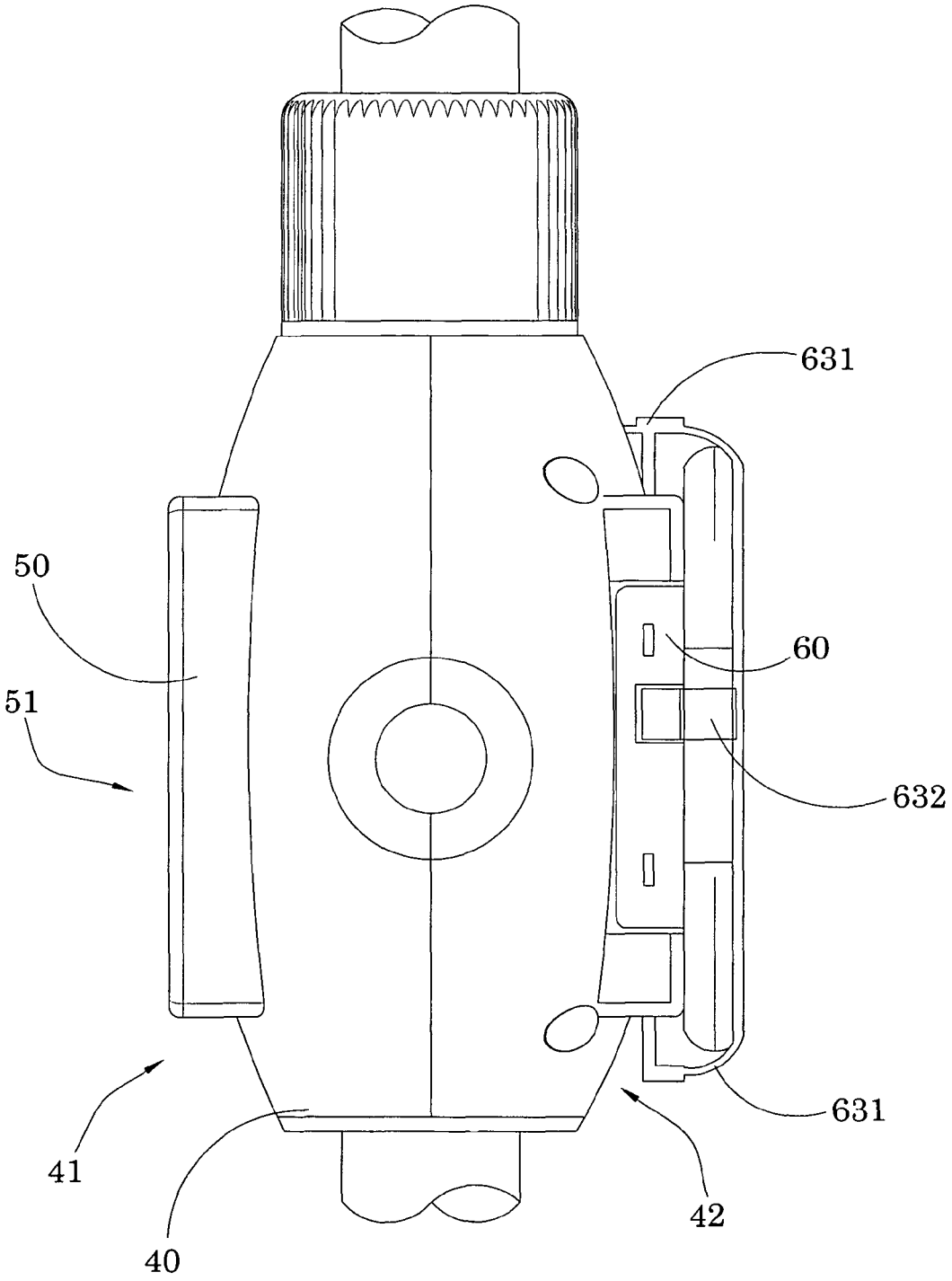
FIG. 8 is a side view of the controller unit according to the above preferred embodiment of the present invention, illustrating the electronic appliance being held at the holding side of the electronic appliance holder.

Accordingly, the electronic appliance holder 60 is able to be detached from the operation housing 40 to select either one of the storage side 61 and the holding side 62 of the electronic appliance holder 60 to be coupled at the second wall surface 42 of the operation housing 40 so as to transform the electronic appliance holder 60 between the storage position and the operation position, as shown in FIG. 3 and FIG. 6 respectively. Therefore, at the storage position of the electronic appliance holder 60, the holding side 62 of the electronic appliance holder 60 is detachably coupled within the receiving cavity 43 of the operation housing 40 so as to embed the electronic appliance holder 60 within the operation housing 40 at the second wall surface 42 thereof. At the operation position, the storage side 61 of the electronic appliance holder 60 is detachably coupled within the receiving cavity 43 of the operation housing 40 so that the holding side 62 of the electronic appliance holder 60 is outwardly protruded from the second wall surface 42 of the operation housing 40 for holding the electronic appliance 20 in position. Therefore, the portable electronic device 21 is able to be supported on the supporting frame 11 while being able to conveniently plug the connecting cable or a connector of the portable electronic device 21 into the connecting slot 53 of the controller unit 50.

It will be readily appreciated that the storage side 61 and the holding side 62 of the electronic appliance holder 60 have identical shape and size corresponding to the receiving cavity 43 for detachably engaging the electronic appliance holder 60 therewith.

Figure 4:
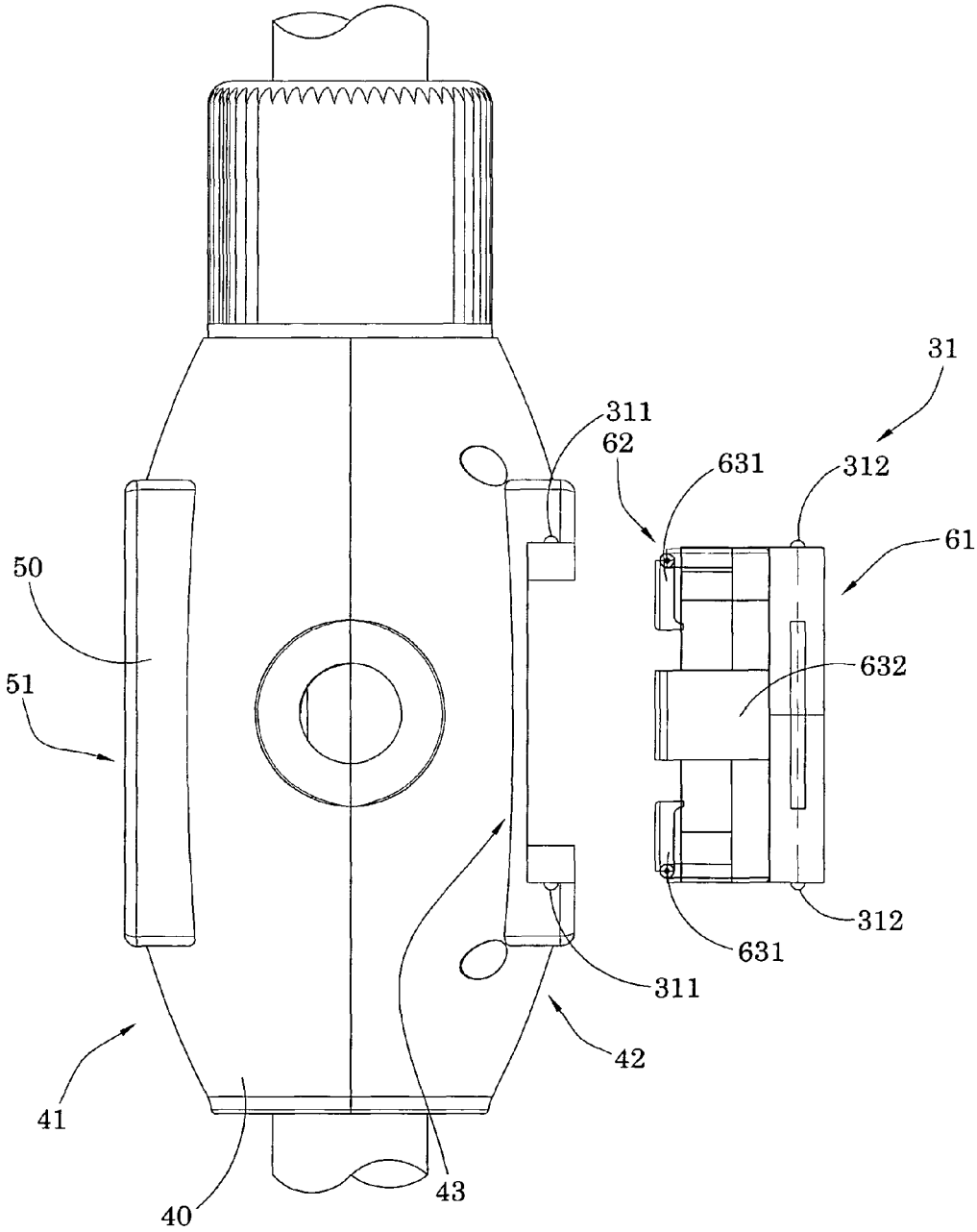
FIG. 4 is another side sectional view of the controller unit according to the above preferred embodiment of the present invention, illustrating the electronic appliance holder being detached from the operation housing.
Figure 5:
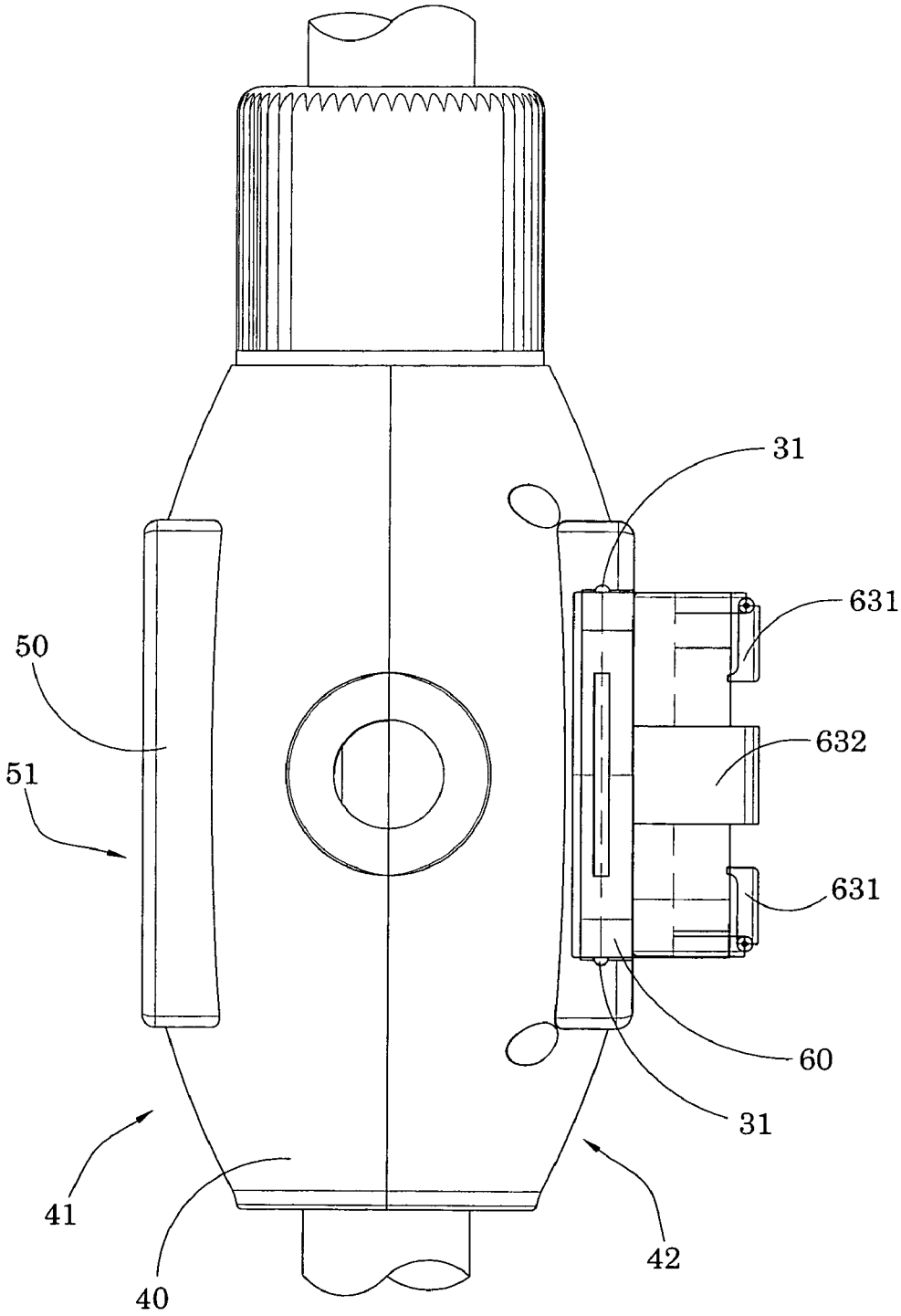
FIG. 5 is another side sectional view of the controller unit according to the above preferred embodiment of the present invention, illustrating the holding side of the electronic appliance holder facing outwardly and the retracting arms at a retracted position.
Figure 12:
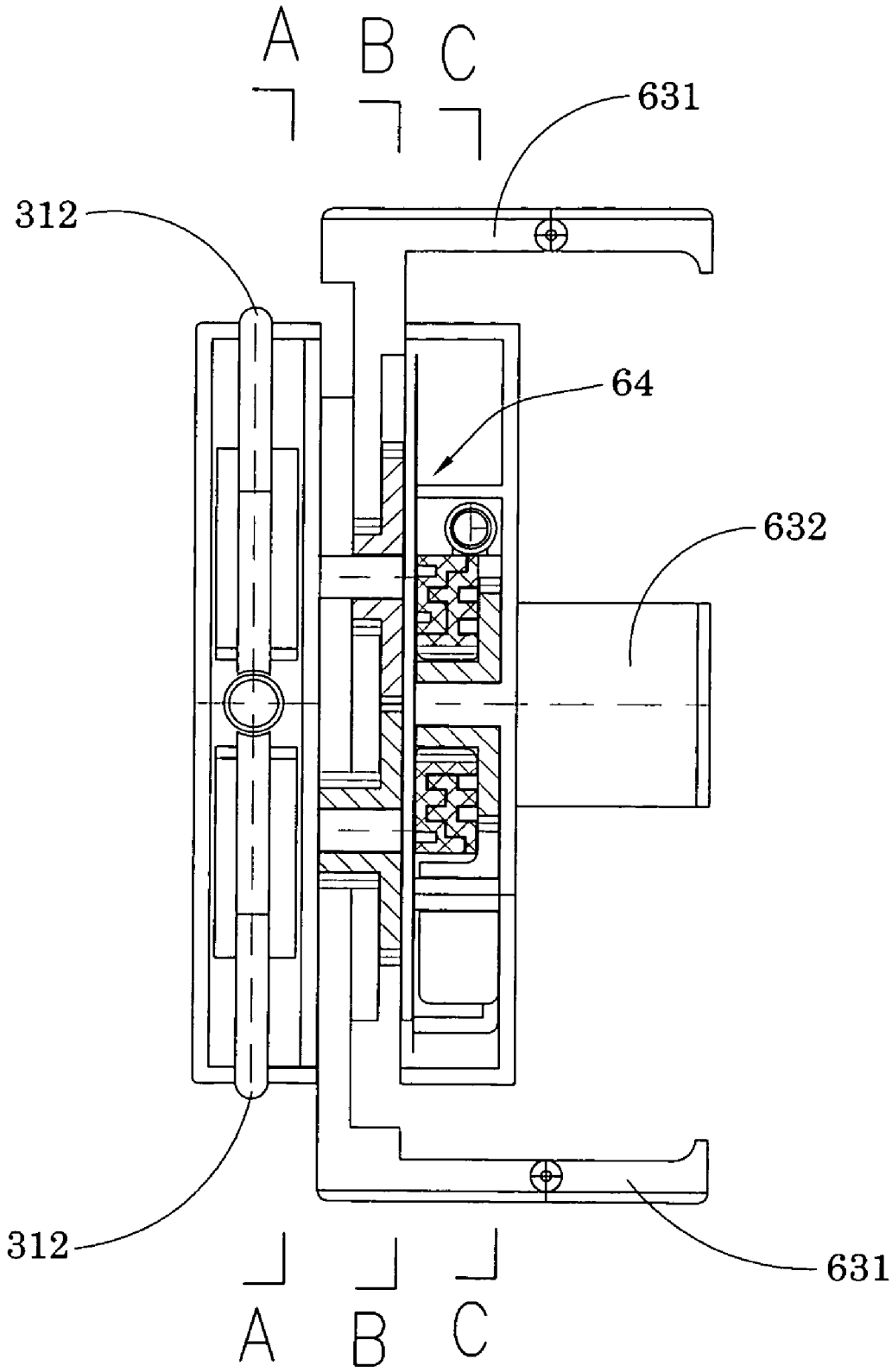
FIG. 12 is a side sectional view of the controller unit according to the above preferred embodiment of the present invention, illustrating the structural configuration of the retraction unit with respect to the FIGS. 11A to 11C.

In order to detachably and securely retain the electronic appliance holder 60 within the receiving cavity 43 of the operation housing 40, the controller unit 30 further comprises a releasable interlocker 31 provided at a peripheral wall of the electronic appliance holder 60 to releasably lock the electronic appliance holder 60 within the receiving cavity 43 of the operation housing 40. As shown in FIGS. 3, 4 and 12, the releasable interlocker 31 has a plurality of engaging slots 311 provided at a surrounding wall of the receiving cavity 43 of the operation housing 40 and comprises a plurality of corresponding resilient protrusions 312 outwardly protruded from the peripheral wall of the electronic appliance holder 60 to releasably engage with the engaging slots 311 respectively so as to securely retain the electronic appliance holder 60 in position. Accordingly, each of the resilient protrusions 312 can be a spring-loaded protrusion that a head portion thereof is outwardly protruded from the peripheral wall of the electronic appliance holder 60 such that when the user applies a pushing force against the electronic appliance holder 60, the head portions of the resilient protrusions 312 are inwardly pressed along the surrounding wall of the receiving cavity 43 until the head portions of the resilient protrusions 312 engage with the engaging slots 311 to interlock the electronic appliance holder 60 within the receiving cavity 43 of the operation housing 40. When the user applies a pulling force against the electronic appliance holder 60, the head portions of the resilient protrusions 312 are inwardly pressed to unlock the electronic appliance holder 60 within the receiving cavity 43 of the operation housing 40. It is worth mentioning that the releasable interlocker 31 will interlock the electronic appliance holder 60 within the receiving cavity 43 of the operation housing 40 at either the storage side 61 or the holding side 62 of the electronic appliance holder 60.

Figure 9:
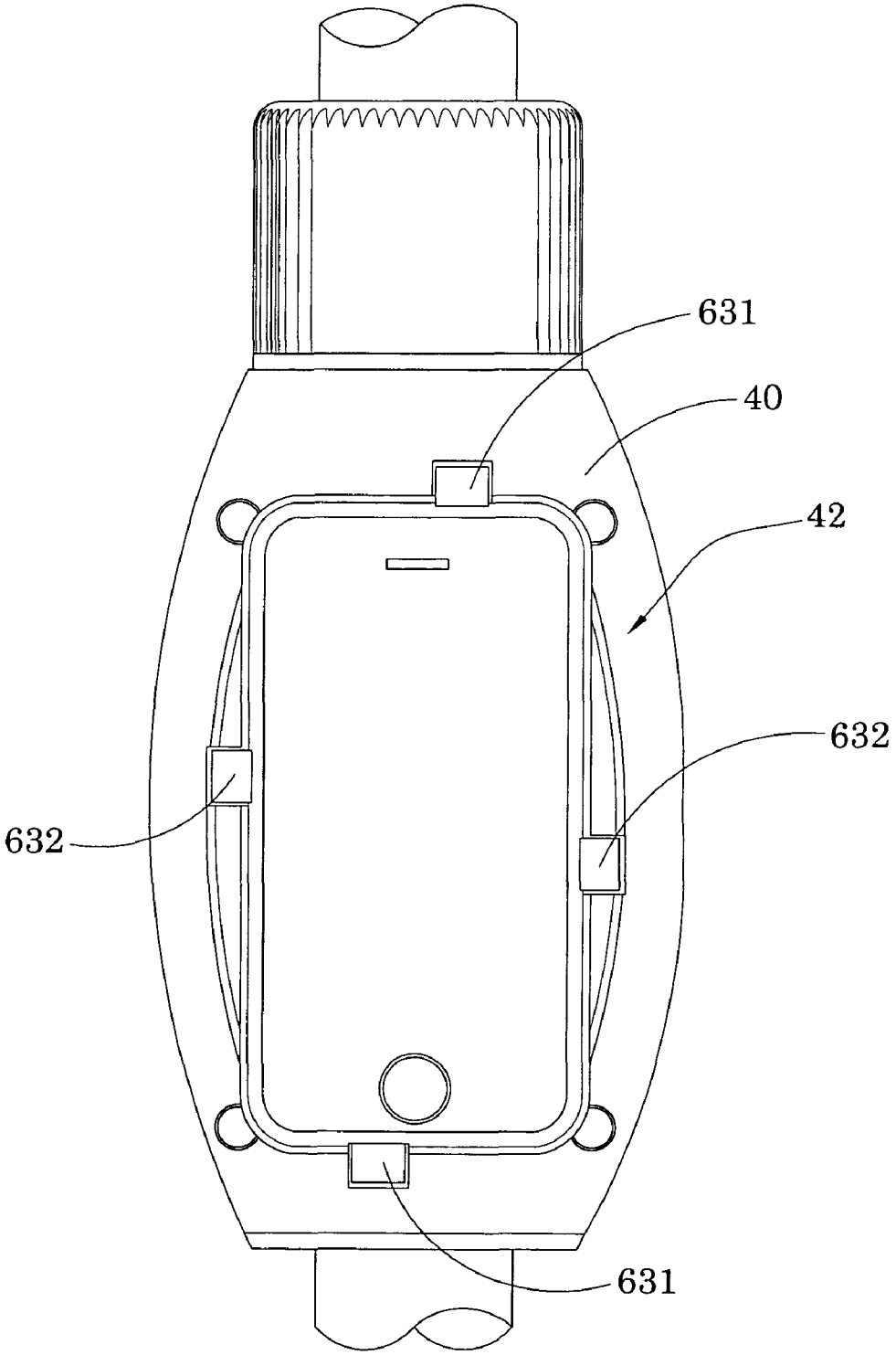
FIG. 9 is a front view of the controller unit according to the above preferred embodiment of the present invention, illustrating the electronic appliance being held at the holding side of the electronic appliance holder at a vertical display orientation.
Figure 10:
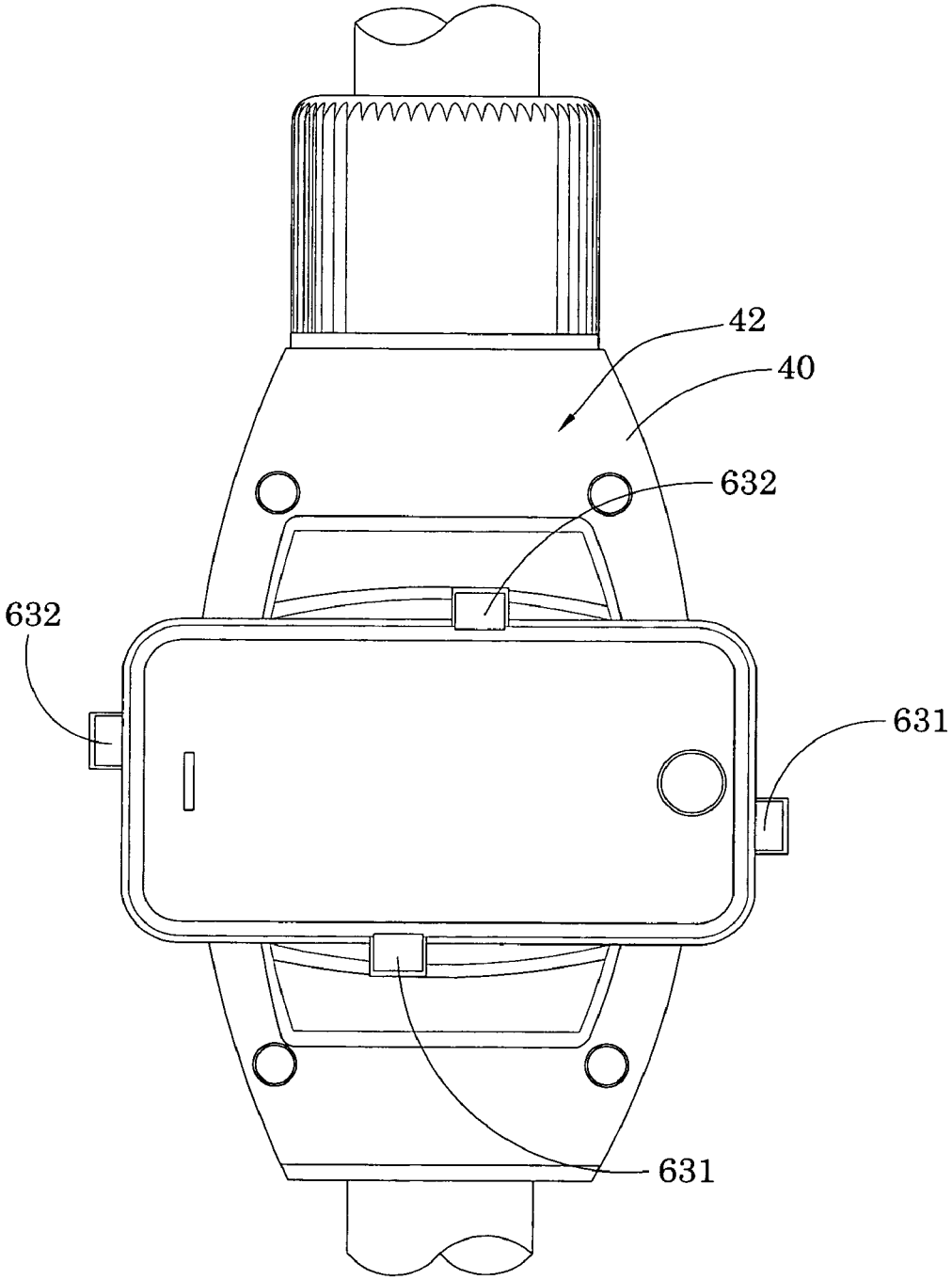
FIG. 10 is a front view of the controller unit according to the above preferred embodiment of the present invention, illustrating the electronic appliance being held at the holding side of the electronic appliance holder at a horizontal display orientation.

The electronic appliance holder 60 further comprises a plurality of length-adjustable retracting arms 63 provided at the holding side 62 of the electronic appliance holder 60 for adjustably holding a surrounding rim of the electronic appliance 20 at the holding side 62 of the electronic appliance holder 60. As shown in FIGS. 9 and 10, the retracting arms 63 are formed in pairs to have a pair of first retracting arms 631 and a pair of second retracting arms 632.

Figure 11A:
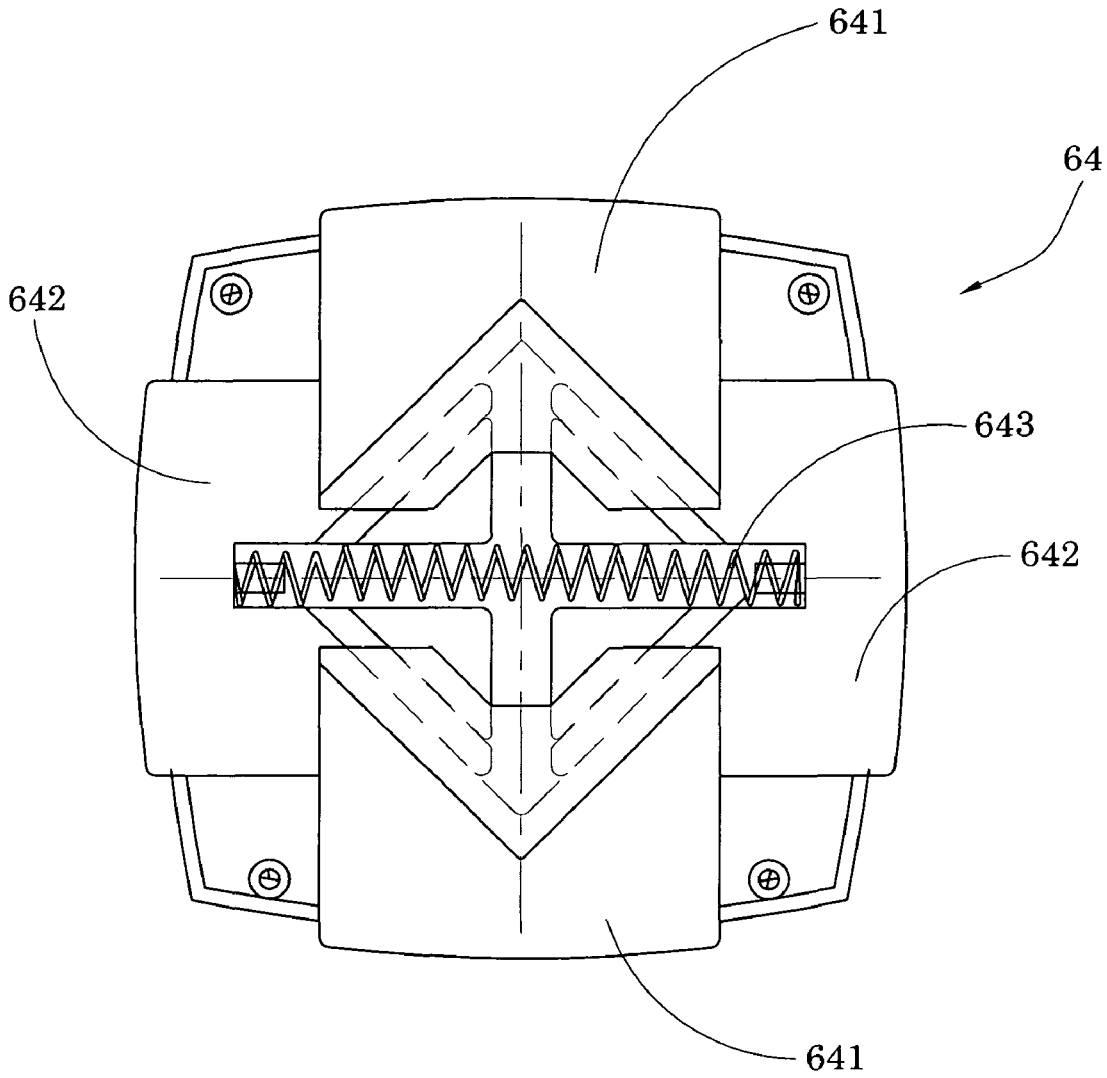
FIGS. 11A to 11C are different sectional views of the controller unit according to the above preferred embodiment of the present invention, illustrating the structural configuration of the retraction unit.

As shown in FIGS. 11A, 11B, 11C, and 12, the electronic appliance holder 60 further comprises a retraction unit 64 to control the retraction operation of the retracting arms 63. As shown in FIG. 11A, the retraction unit 64 comprises two transverse locking panels 641, and two longitudinal locking panels 642 inter-engaging with the transverse locking panels 641, and a first spring element 643 biasing between the longitudinal locking panels 642. Accordingly, when a pressing force is applied at the transverse locking panels 641 to reduce the distance therebetween, the longitudinal locking panels 642 are driven to be pressed to reduce the distance therebetween as well so as to compress the first spring element 643. Once the pressing force is released, the first spring element 643 is returned to its original form to outwardly push the longitudinal locking panels 642 as well as the transverse locking panels 641.

Figure 11B:
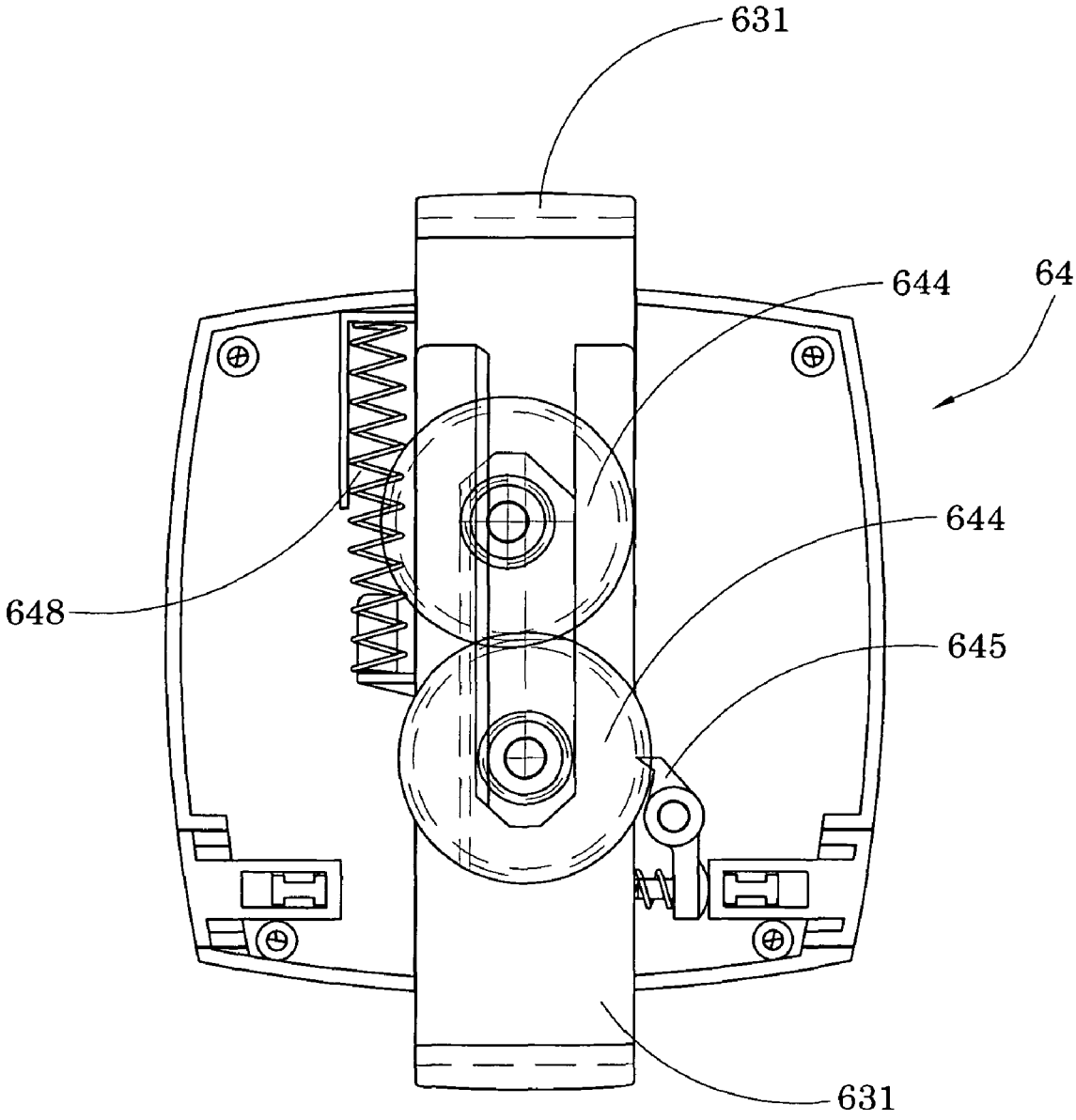

As shown in FIG. 11B, the first retracting arms 631 are alignedly and movably supported in a spaced manner, wherein two first gear members 644 are rotatably coupled with each other and are coupled with the first retracting arms 631 respectively. Preferably, the outer free end of each of the first retracting arms 631 has a hook shape that the distance between the two free ends of the first retracting arms 631 can be selectively adjusted between 55 and 160 mm to hold the electronic appliance in position. A spring-loaded first locking member 645 is movably engaged with one of the first gear members 644, wherein when a pressing force is applied at the free ends of the first retracting arms 631 to drive the first retracting arms 631 towards each other, the first gear members 644 are driven to correspondingly rotated such that when the first locking member 645 releasably engaged with the corresponding first gear member 644, the sliding movements of the first retracting arms 631 are stopped to retain the distance between the free ends of the first retracting arms 631 so as to universally hold variety of sizes of the portable electronic devices 21.

Figure 11C:
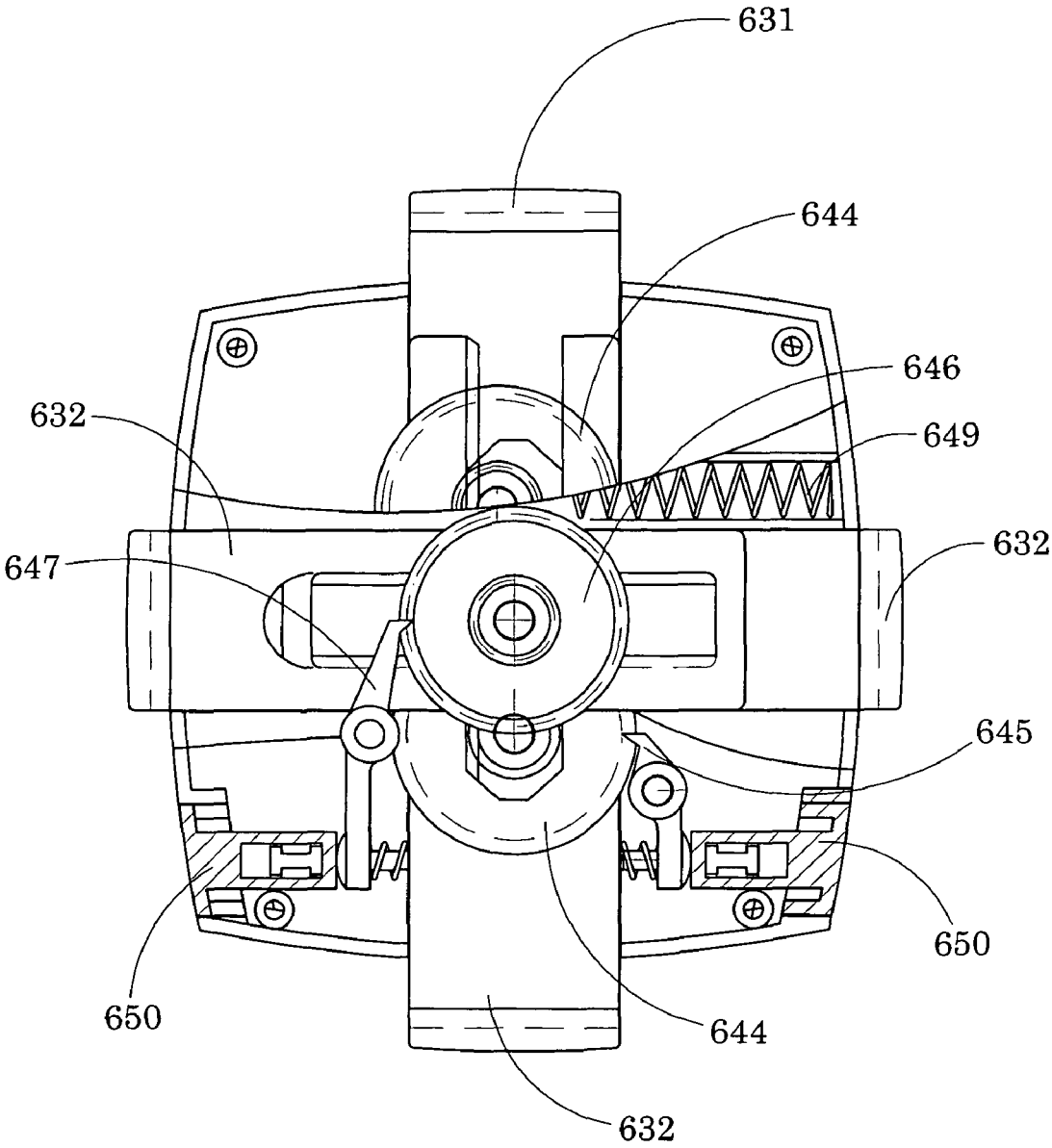

As shown in FIG. 11C, the second retracting arms 632 are alignedly and movably supported in a spaced manner, wherein a second gear member 646 is rotatably coupled with the second retracting arms 632 respectively. Preferably, the outer free end of each of the second retracting arms 632 has a hook shape that the distance between the two free ends of the second retracting arms 632 can be selectively adjusted to hold the electronic appliance in position. A spring-loaded second locking member 647 is movably engaged with the second gear members 647, wherein when a pressing force is applied at the free ends of the second retracting arms 632 to drive the second retracting arms 632 towards each other, the second gear member 646 is driven to correspondingly rotated such that when the second locking member 647 releasably engaged with the second gear member 646, the sliding movements of the second retracting arms 632 are stopped to retain the distance between the free ends of the second retracting arms 632. As shown in FIGS. 11B and 11C, a second spring element 648 is provided for biasing against the first retracting arms 631 to push the first retracting arms 631 away from each other. A third spring element 649 is provided for biasing against the second retracting arms 632 respectively to push the second retracting arms 632 away from each other.

In order to release the locking position of each of the first and second retracting arms 631, 632, a locker unit 650 is provided to drive the first and second locking members 645, 647 to move. The locker unit 650 comprises two spring-loaded actuators alignedly coupled with the first and second locking members 645, 647, wherein when the actuators are pressed, the first and second locking members 645, 647 are driven to move to release the engagement of the first and second gear members 644, 646 respectively, such that the first and second retracting arms 631, 632 are pushed outwardly via the second and third spring elements 648, 649 respectively.

The electronic appliance holder 60 further comprises a turntable base 66 rotatably coupling at the holding side 62 of the electronic appliance holder 60, wherein the retracting arms 63 are radially and outwardly extended from the turntable base 66 such that the turntable base 66 is adjustably rotated at the holding side 62 of the electronic appliance holder 60 to selectively adjust the electronic appliance between a vertical display orientation, as shown in FIG. 9, and a horizontal display orientation, as shown in FIG. 10. Therefore, the user is able to selectively adjust a viewing orientation of the portable electronic device 21.

It is worth mentioning that when the holding side 62 of the electronic appliance holder 60 is coupled at the second wall surface 42 of the operation housing 40 within the receiving cavity 43, the first and second retracting arms 631, 632 are received within the receiving cavity 43 in a hidden manner such that the storage side 61 of the electronic appliance holder 60 is aligned with the second wall surface 42 of the operation housing 40 so as to keep the aesthetic appearance of the outdoor shading device 10 and to minimize the overall size of the operation housing 40 at the storage position with the electronic appliance holder 60.

Figure 13:
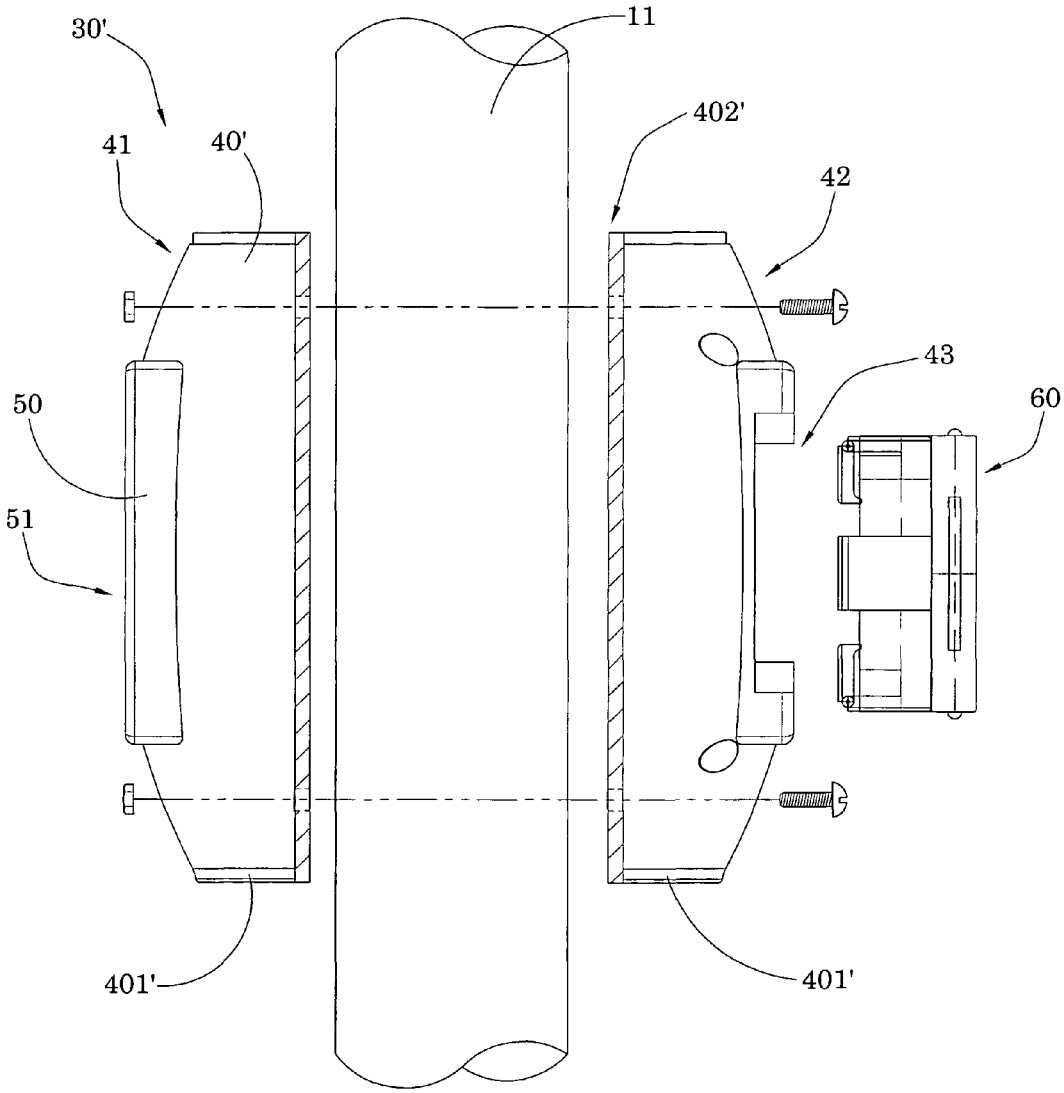
FIG. 13 illustrates an alternative mode the operation housing according to the above preferred embodiment of the present invention, illustrating the controller unit being detachably coupled with the outdoor shading device.

FIG. 13 illustrates an alternative mode of the controller unit 30' of the preferred embodiment, wherein the controller unit 30' is an added-on component of the outdoor shading device 10. As shown in FIG. 13, the operation housing 40' of the controller unit 30' comprises two housing members 401' detachably coupling with each other and defining a shaft cavity 402' for the shaft of the supporting frame 11 receiving thereat.

Therefore, the operation housing 40' can be detachably mounted at the supporting frame 11 via any fastener, such as screw in FIG. 13. In other words, the controller unit 30' can be incorporated with any outdoor shading device 10 having the supporting frame 11 to hold the electronic appliance 20 at the second wall surface 42 of the operation housing 40' via the electronic appliance holder 60 and to control the electronic appliance 20 by the control panel 50 at the first wall surface 41 of the operation housing 40'. For example, the outdoor shading device 10 can be a canopy which comprises a canopy awning supported by a canopy supporting frame, wherein the canopy supporting frame comprises an awning supporting frame and a plurality of canopy supporting shafts. The operation housing 40' can be provided at either the awning supporting frame or one of the canopy supporting shafts.

It is worth mentioning that the control panel 40 can also be detachably coupled at the first wall surface 41 of the operation housing 40 via the same mechanism of the releasable interlocker 31 such that the control panel 40 not only wirlessly links to the electronic appliance 20 at the second wall surface 42 of the operation housing 40 via the electronic appliance holder 60, but also forms a remote control to wirelessly control the electronic appliance 20. It is appreciated that an additional cavity can be formed at the first wall surface 41 of the operation housing 40 to receive the control panel 40 at the cavity of the operation hosing 40.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor shading device, comprising:

a supporting frame;

an awning frame movably supported by said supporting frame to define a shading area under said awning frame; and a controller unit, comprising:

an operation housing mounted on said supporting frame at a hand reachable location, wherein said operation housing has a first wall surface, a second wall surface and a receiving cavity indently formed at said second wall surface to detachably receive said electronic appliance holder within said receiving cavity;

a control panel being supported at said first wall surface of said operation housing; and an electronic appliance holder provided at said second wall surface of said operation housing for holding at least an electronic appliance thereat, wherein said control panel is adapted for communicatively linking to said electronic appliance to selectively control an operation of said electronic appliance, wherein said electronic appliance holder has a storage side and an opposed holding side arranged in such a manner that when said storage side of said electronic appliance holder is engaged with said operation housing, said holding side of said electronic appliance holder faces outwardly for holding said electronic appliance in position, and when said holding side of said electronic appliance holder is engaged with said operation housing, said storage side of said electronic appliance holder is aligned with said second wall surface to house said electronic appliance holder at said operation housing, wherein said electronic appliance holder further comprises a plurality of length-adjustable retracting arms provided at said holding side of said electronic appliance holder for adjustably holding a surrounding rim of said electronic appliance at said holding side of said electronic appliance holder, wherein said electronic appliance holder further comprises a turntable base rotatably coupling at said holding side of said electronic appliance holder, wherein said retracting arms are radially and outwardly extended from said turntable base such that said turntable base is adjustably rotated at said holding side of said electronic appliance holder to selectively adjust said electronic appliance between a vertical display orientation and a horizontal display orientation.

2. An outdoor shading device, comprising:

a supporting frame;

an awning frame movably supported by said supporting frame to define a shading area under said awning frame; and a controller unit, comprising:

an operation housing mounted on said supporting frame at a hand reachable location, wherein said operation housing has a first wall surface, a second wall surface a receiving cavity indently formed at said second wall surface to detachably receive said electronic appliance holder within said receiving cavity;

a control panel being supported at said first wall surface of said operation housing;

an electronic appliance holder provided at said second wall surface of said operation housing for holding at least an electronic appliance thereat, wherein said control panel is adapted for communicatively linking to said electronic appliance to selectively control an operation of said electronic appliance, wherein said electronic appliance holder has a storage side and an opposed holding side arranged in such a manner that when said storage side of said electronic appliance holder is engaged with said operation housing, said holding side of said electronic appliance holder faces outwardly for holding said electronic appliance in position, and when said holding side of said electronic appliance holder is engaged with said operation housing, said storage side of said electronic appliance holder is aligned with said second wall surface to house said electronic appliance holder at said operation housing, wherein said electronic appliance holder further comprises a plurality of length-adjustable retracting arms provided at said holding side of said electronic appliance holder for adjustably holding a surrounding rim of said electronic appliance at said holding side of said electronic appliance holder, wherein said electronic appliance holder further comprises a turntable base rotatably coupling at said holding side of said electronic appliance holder, wherein said retracting arms are radially and outwardly extended from said turntable base such that said turntable base is adjustably rotated at said holding side of said electronic appliance holder to selectively adjust said electronic appliance between a vertical display orientation and a horizontal display orientation; and a releasable interlocker provided at a peripheral wall of said electronic appliance holder to releasably lock said electronic appliance holder within said receiving cavity of said operation housing, wherein said releasable interlocker has a plurality of engaging slots provided at a surrounding wall of said receiving cavity of said operation housing and comprises a plurality of corresponding resilient protrusions outwardly protruded from said peripheral wall of said electronic appliance holder to releasably engage with said engaging slots respectively so as to securely retain said electronic appliance holder in position.

3. The outdoor shading device, as recited in claim 2, wherein said control panel comprises a controller interface and a wireless communication link for communicatively linking with said electronic appliance in a wireless connection manner, so as to enable said controller interface being activated to control the operation of said electronic appliance.

4. The outdoor shading device, as recited in claim 3, further comprising a speaker system supported within said shading area under the awning frame, wherein said control panel is operatively linked to said speaker system for communicatively linking said speaker system with said electronic appliance.

5. The outdoor shading device, as recited in claim 4, further comprising an awning folding arrangement provided at said operation housing for controlling a folding operation of said awning between an unfolded position and a folded position, wherein said awning folding arrangement comprises a folding cable extended from said operation housing to said awning frame and a manual operation handle rotatably coupled at said operation housing to control said folding cable.

6. A controller unit for an outdoor shading device which comprises a supporting frame and an awning frame supported by said supporting frame to define a shading area under said awning frame, wherein said controller unit comprises:

an operation housing adapted for detachably mounting on said supporting frame at a hand reachable location, wherein said operation housing has a first wall surface, a second wall surface and a receiving cavity indently formed at said second wall surface to detachably receive said electronic appliance holder within said receiving cavity;

a control panel being supported at said first wall surface of said operation housing;

an electronic appliance holder provided at said second wall surface of said operation housing for holding at least an electronic appliance thereat, wherein said control panel is adapted for communicatively linking to said electronic appliance to selectively control an operation of said electronic appliance, wherein said electronic appliance holder has a storage side and an opposed holding side arranged in such a manner that when said storage side of said electronic appliance holder is engaged with said operation housing, said holding side of said electronic appliance holder faces outwardly for holding said electronic appliance in position, and when said holding side of said electronic appliance holder is engaged with said operation housing, said storage side of said electronic appliance holder is aligned with said second wall surface to house said electronic appliance holder at said operation housing, wherein said electronic appliance holder further comprises a plurality of length-adjustable retracting arms provided at said holding side of said electronic appliance holder for adjustably holding a surrounding rim of said electronic appliance at said holding side of said electronic appliance holder, wherein said electronic appliance holder further comprises a turntable base rotatably coupling at said holding side of said electronic appliance holder, wherein said retracting arms are radially and outwardly extended from said turntable base such that said turntable base is adjustably rotated at said holding side of said electronic appliance holder to selectively adjust said electronic appliance between a vertical display orientation and a horizontal display orientation; and a releasable interlocker provided at a peripheral wall of said electronic appliance holder to releasably lock said electronic appliance holder within said receiving cavity of said operation housing, wherein said releasable interlocker has a plurality of engaging slots provided at a surrounding wall of said receiving cavity of said operation housing and comprises a plurality of corresponding resilient protrusions outwardly protruded from said peripheral wall of said electronic appliance holder to releasably engage with said engaging slots respectively so as to securely retain said electronic appliance holder in position.

7. The controller unit, as recited in claim 6, wherein said control panel comprises a controller interface and a wireless communication link for communicatively linking with said electronic appliance and a speaker system of said outdoor shading device in a wireless connection manner, so as to enable said controller interface being activated to control the operation of said electronic appliance and said speaker system.

8. A controller unit for an outdoor shading device which comprises a supporting frame and an awning frame supported by said supporting frame to define a shading area under said awning frame, wherein said controller unit comprises:

an operation housing adapted for detachably mounting on said supporting frame at a hand reachable location, wherein said operation housing has a first wall surface and a second wall surface;

a control panel being supported at said first wall surface of said operation housing; and an electronic appliance holder provided at said second wall surface of said operation housing for holding at least an electronic appliance thereat, wherein said control panel is adapted for communicatively linking to said electronic appliance to selectively control an operation of said electronic appliance, wherein said electronic appliance holder comprises a plurality of length-adjustable retractable arms provided at a holding side of said electronic appliance holder and a turntable base rotatably coupling at said holding side of said electronic appliance holder, wherein said retracting arms are radially and outwardly extended from said turntable base such that said turntable base is adjustably rotated at said holding side of said electronic appliance holder to selectively adjust said electronic appliance between a vertical display orientation and a horizontal display orientation.

9. The controller unit, as recited in claim 8, wherein said control panel comprises a controller interface and a wireless communication link for communicatively linking with said electronic appliance and a speaker system of said outdoor shading device in a wireless connection manner, so as to enable said controller interface being activated to control the operation of said electronic appliance and said speaker system.

* * * * *